United States Patent [19]

Arndt

[11] 4,106,352

[45] Aug. 15, 1978

[54] WIRE POINTING MACHINE

[75] Inventor: Walter Arndt, Meschede, Fed. Rep. of Germany

[73] Assignee: Firma Friedrich Krollmann, Altena, Fed. Rep. of Germany

[21] Appl. No.: 783,847

[22] Filed: Apr. 1, 1977

[51] Int. Cl.[2] ..... F16H 19/04

[52] U.S. Cl. ..... 74/29; 72/78

[58] Field of Search ..... 72/278, 284, 78; 74/29, 74/30

[56] References Cited

U.S. PATENT DOCUMENTS

| | | | |
|---|---|---|---|
| 569,087 | 10/1896 | Burnham | 72/78 |
| 696.344 | 3/1902 | DeLaval et al. | 72/284 |
| 1,386,156 | 8/1921 | Butterfield | 72/78 |

*Primary Examiner*—Benjamin W. Wyche
*Assistant Examiner*—Wesley S. Ratliff, Jr.
*Attorney, Agent, or Firm*—Bacon & Thomas

[57] ABSTRACT

The wire pointing machine comprises two grooved rolls which are supported in a gear ring pivotable about a horizontal axis. Teeth are provided on end trunnions of the grooved rolls which mesh with a common gear rack which is directly powerdriven.

10 Claims, 4 Drawing Figures

WIRE POINTING MACHINE

The invention relates to a wire pointing machine with two grooved rolls.

Known wire pointing machines are constructed so that the wire is fed in through a feed profile of the roll pass as far as a stop abutment and is then rolled back. The circumferential motion of the grooved rolls is opposite to the feed-in direction in the roll gap. The wire must be rotated through 90° to obtain a cylindrical point. These known wire pointing machines are complicated and heavy and must be fixedly installed at a specific distance from the wire drawing machine. The wire end for pointing must be uncoiled from the capstan for transfer to the pointing machine. Turning the wire is also exceptionally difficult because several turns of the coil must be upended. The heaviest operations of this kind are subject to a substantial accident hazard.

Wire pointing machines are also known having oscillating rolls which are rotated in the forward and reverse direction by means of a hand lever or a crank.

The prior art also discloses wire pointing machines with two pairs of rolls the axes of which are arranged perpendicularly to each other. Turning the wire through 90° is obviated in these machines. However, these machines are even heavier and more comprehensive.

It is the object of the invention to provide a wire pointing machine which can be used directly adjacent to the wire drawing machine and dispenses with the need for turning the wire end.

According to the invention there is provided a wire pointing machine having two grooved rolls, characterized in that the two grooved rolls are supported in a gear ring which can be pivoted about a horizontal axis, teeth being provided on end trunnions of the grooved rolls which mesh with a common gear rack which is directly powerdriven.

The invention therefore permits the rolls to be turned within the gear ring, thus dispensing with the need for rotating the wire end. The preferred use of a hydraulic drive with a gear rack simplifies and facilitates the roll drive so that the entire machine can be constructed in a compact and light-weight manner. The wire end is fed-in in the rolling direction in the course of the pointing stroke, so that a short wire end can be drawn off from the capstan for transfer to the pointing machine. The pointing machine can be installed directly adjacent to the capstan.

To simplify the driving means, the gear rack end opposite to the working piston may be constructed directly as a return piston and accommodated in a cylinder chamber the cross-section of which corresponds to the cross-sectional surface area of the gear rack.

The invention also envisages in a preferred example the provision of interchangeable cross-cutting knives on the grooved rolls. The end of the wire can therefore be always neatly cut off after pointing.

The gear ring may be suspended in a portal frame so as to be self-aligning. The suspension of the gear ring is vertically adjustable. The frame is provided with running wheels.

The invention therefore provides a wire pointing machine which can be driven to the appropriate operating place and can be adapted to the appropriate pointing conditions. It is therefore possible to move the wire pointing machine close to the wire drawing machine.

The wire pointing machine can even be inserted between the capstan and the die so that only a very short wire section need be inserted between the grooved rolls. The gear ring is self-aligning so that during the rolling operation the said gear ring is moved upon the wire which is to be pointed.

The invention will now be described by way of example with reference to the accompanying drawings, in which.

Figure 1:
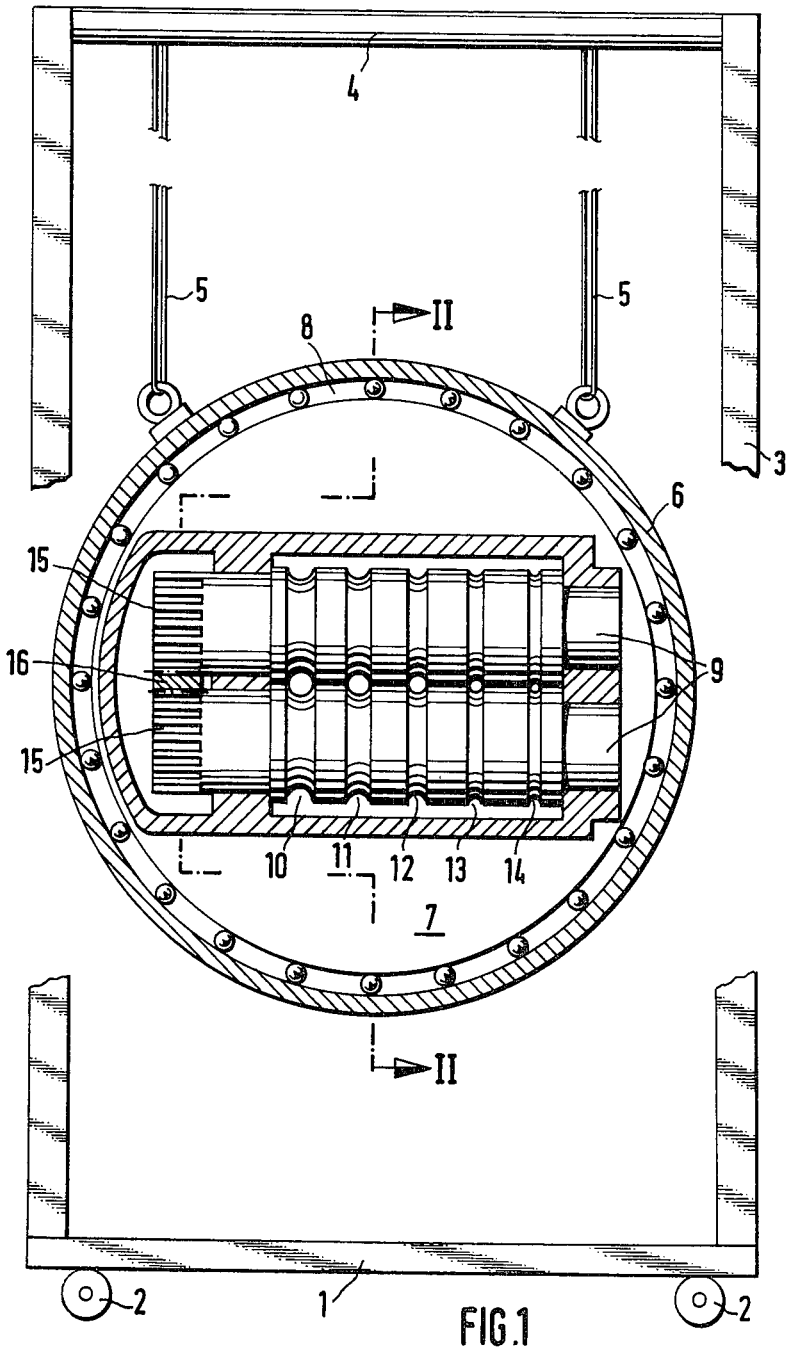
FIG. 1 is a partially sectioned view of a wire pointing machine.

The wire pointing machine shown in the drawings comprises a base 1 (FIGS. 1 and 2) mounted on running wheels 2 which are at least partially pivotable about a vertical axis. A portal frame 3 with a top yoke 4 is mounted on the base 1. The frame 3 is shown in broken away form. A gear ring 6 is suspended on the yoke 4 by means of ropes or chains 5 so as to be self-aligning. The ropes 5 are also shown in broken away form. The ropes or chains 5 co-operate with a coiling device (not shown) so that the gear ring can be raised and lowered in the vertical direction. The gear ring 6 has an inner frame 7 which can rotate with respect to said gear ring about a horizontal axis on bearings 8.

Two grooved rolls 9 are rotatably supported in the frame 7. The grooved rolls 9 are situated vertically one above the other. The grooved rolls 9 have different roll passes 10, 11, 12, 13, 14 for different wire gauges. End trunnions 15 of the grooved rolls are provided with circumferential teeth. The teeth are in mesh with a common gear rack 16. One end of the gear rack 16 supports a piston 17, the cross-sectional surface area of which is substantially larger than the cross-sectional surface area of the gear rack 16. The piston 17 is slidingly disposed in the chamber of a pressure medium cylinder 18. The other end of the gear rack 16 is constructed directly as piston 19 and is situated in a corresponding cylinder chamber 20. The different cross-sections of the pressure medium cylinder allow for the appropriate working rate of the pointing stroke and of the return stroke.

Figure 3:
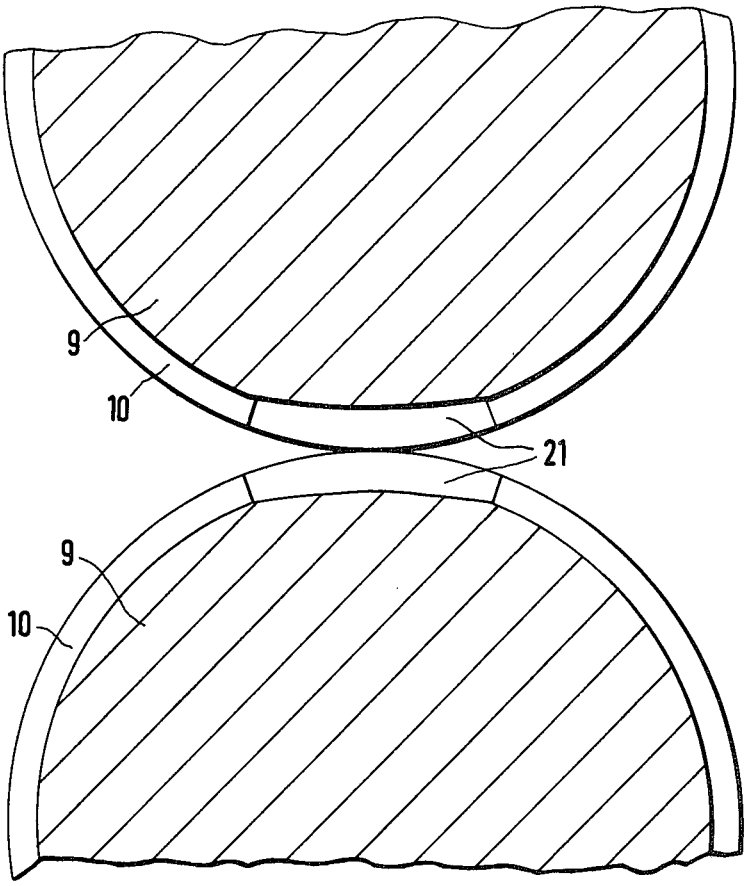
FIG. 3 is a partial section perpendicular to the rolling axis of the machine shown to an enlarged scale.

FIG. 3 shows to an enlarged scale a partial section through the grooved rolls 9 and clearly shows the enlarged portion 21 of the roll pass 10.

Figure 4:
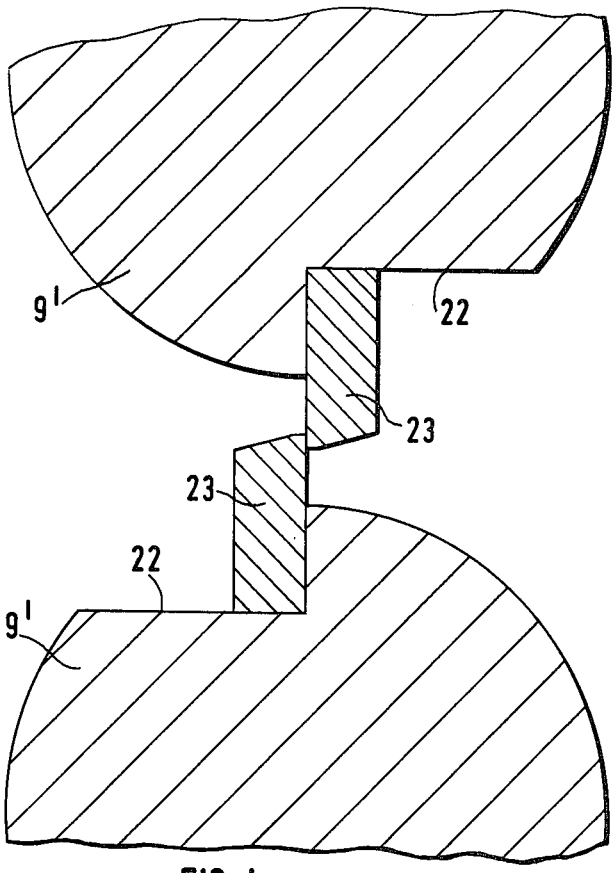
FIG. 4 is a partial section at right angles to the roll axis of the machine shown to an enlarged scale.

FIG. 4 is a sectional view of a modified embodiment of the grooved rolls 9', the grooved rolls having holders 22 for interchangeable cross-cutting blades 23.

Figure 2:
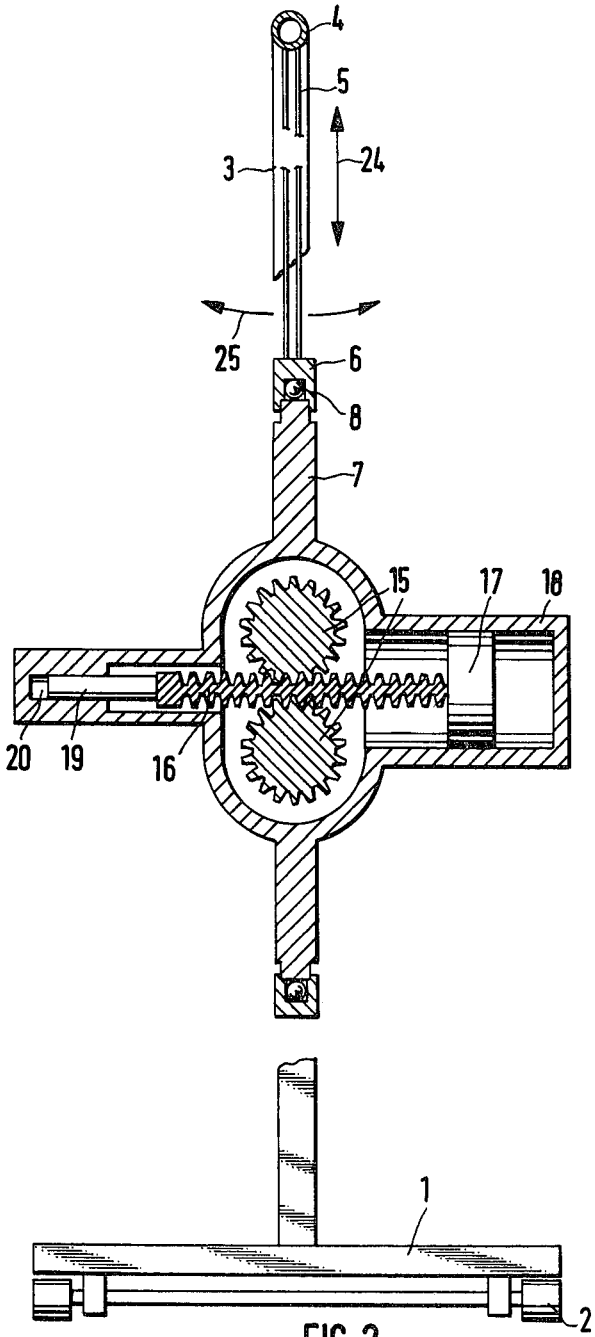
FIG. 2 is a section along the line II—II of FIG. 1.

The wire pointing machine operates as follows. The gear ring 6 is mounted on the yoke 4 so that it can be raised and lowered in the direction of the double arrow 24. The gear ring 6 can also move freely in the direction of the double arrow 25. The frame 3 can traverse into the desired operating position by means of the running wheels 2 and can thus be moved close to the wire drawing machine, directly adjacent to the capstan. The gear ring 6 is set to the desired height so that the beginning of the wire is aligned with the roll gap. The beginning of the wire is inserted from the right into the roll pass, as shown in FIG. 2. If the pressure medium cylinder 18 is biassed with pressure medium, the grooved rolls 9 will be rotated by means of the piston 17 and the rack 16 so that the beginning of the wire is inwardly drawn in the feed direction and is thus pointed. In the course of this pointing stroke the gear ring 6 moves self-aligning to the right. On completion of the pointing stroke, the enlarged portions 21 of the roll pass 10 are opposite, shown in FIG. 3 so that the inner frame 7 can be rotated freely about 90° since the wire has a clearance to the inner surfaces of said enlarged portions. Thereafter the cylinder chamber 20 is biassed with pressure medium so that the gear rack 16 traverses in the reverse direction into the starting position by means of a return stroke. This causes the grooved rolls 9 to be rotated in the reverse direction so that the wire portion is rolled in a reverse pass. The gear ring reverses in the course of this motion. The wire end can then be withdrawn from the roll pass. By said operation it is possible to obtain a round pointing cross-section.

On completion of the pointing operation, the wire end is neatly cut by means of the cross-cutting blade 23.

The illustrated wire pointing machine permits the production of a cylindrical pointing profile. Other pointing cross-sections can also be produced with other roll passes, diamond passes or flat passes. For this procedure the enlarged portion of the roll passes can be used as exit profile.

What I claim is:

1. A wire pointing machine having two grooved rolls, characterised in that the two grooved rolls are supported in a gear ring which can be pivoted about a horizontal axis, teeth being provided on end trunnions of the grooved rolls which mesh with a common gear rack which is directly powerdriven.

2. A wire pointing machine according to claim 1, characterised in that the gear rack is a piston rod of a double-acting pressure medium unit.

3. A wire pointing machine according to claim 2, characterised in that a working piston with a cross-section larger than that of the piston rod is situated at one end of the piston rod, the said piston being guided in a pressure medium cylinder for a pointing stroke.

4. A wire pointing machine according to claim 3, characterised in that a turning device of the grooved rolls associated with the pointing stroke is defined with respect to a feed side of the machine so that the circumferential motion of the grooved rolls in the roll gap is directed in the feed direction in the course of the pointing stroke.

5. A wire pointing machine according to claim 3, characterised in that the end of the gear rack situated opposite to the working piston is constructed directly as a resetting piston and is accommodated in a cylinder chamber, the cross-section of which corresponds to the cross-sectional surface area of the gear rack.

6. A wire pointing machine according to claim 1, characterised in that each of the roll passes has an enlarged portion.

7. A wire pointing machine according to claim 1, characterised in that cross-cutting blades are provided on the grooved rolls.

8. A wire pointing machine according to claim 1, characterised in that the gear ring is suspended in a portal frame so as to be self-aligning.

9. A wire pointing machine according to claim 8, characterized in that the suspension of the gear ring is constructed so as to be vertically adjustable.

10. A wire pointing machine according to claim 8, characterized in that the frame is provided with running wheels.

* * * * *